US008354906B2

(12) United States Patent
Nagura et al.

(10) Patent No.: US 8,354,906 B2
(45) Date of Patent: Jan. 15, 2013

(54) ELECTROMAGNETIC RELAY

(75) Inventors: Hiroshi Nagura, Okazaki (JP); Takashi Ito, Nagoya (JP); Masaki Takeyama, Okazaki (JP)

(73) Assignee: Anden Co., Ltd., Anjo (JP)

( * ) Notice: Subject to any disclaimer, the term of this patent is extended or adjusted under 35 U.S.C. 154(b) by 429 days.

(21) Appl. No.: 12/461,780

(22) Filed: Aug. 25, 2009

(65) Prior Publication Data

US 2010/0060394 A1 Mar. 11, 2010

(30) Foreign Application Priority Data

Sep. 5, 2008 (JP) ..... 2008-228005
Feb. 2, 2009 (JP) ..... 2009-021295

(51) Int. Cl.
*H01H 9/30* (2006.01)

(52) U.S. Cl. ..... 335/201; 335/78; 335/128

(58) Field of Classification Search ..... 335/78–86, 335/124, 128–135, 201
See application file for complete search history.

(56) References Cited

U.S. PATENT DOCUMENTS

| | | | | |
|---|---|---|---|---|
| 4,404,443 | A * | 9/1983 | Coynel et al. | 218/23 |
| 4,571,566 | A * | 2/1986 | Saur | 335/78 |
| 5,546,061 | A * | 8/1996 | Okabayashi et al. | 335/78 |
| 6,075,429 | A * | 6/2000 | Uotome et al. | 335/78 |
| 7,145,422 | B2 * | 12/2006 | Imanishi et al. | 335/201 |
| 7,541,901 | B2 * | 6/2009 | Nakano et al. | 335/201 |
| 7,782,162 | B2 * | 8/2010 | Nishida | 335/201 |
| 2009/0072935 | A1 * | 3/2009 | Yuba et al. | 335/201 |

FOREIGN PATENT DOCUMENTS

| | | |
|---|---|---|
| JP | U-S53-031275 | 8/1976 |
| JP | U-S56-021343 | 7/1979 |
| JP | U-S61-197633 | 10/1986 |
| JP | 10326553 A * | 12/1998 |
| JP | A-2003-288830 | 10/2003 |
| JP | A-2006-351240 | 12/2006 |

OTHER PUBLICATIONS

U.S. Appl. No. 12/461,970, filed Aug. 31, 2009, Nagura et al.
Office Action mailed Jul. 17, 2012 in a corresponding Japanese application No. 2008-228005.

* cited by examiner

*Primary Examiner* — Bernard Rojas
(74) *Attorney, Agent, or Firm* — Posz Law Group, PLC

(57) ABSTRACT

An electromagnetic relay includes a case, a base, a magnet coil, a movable member driven by electromagnetic force of the coil, a moving contact, a fixed contact engaged with or disengaged from the moving contact, a fixed contact holding member fixed to the base with the holding member passing therethrough and having a load circuit terminal, and a magnet applying Lorentz force to arc generated between the fixed contact and the moving contact. The case includes a guide part on its region with which arc extended in a Lorentz force application direction collides. The guide part guides arc after the collision to extend arc in a different direction from the application direction. The case includes a case partition wall between the guide part and the base. The holding member has a guide part opposing portion opposed to the guide part. The opposing portion is covered with the case partition wall.

4 Claims, 7 Drawing Sheets

ELECTROMAGNETIC RELAY

CROSS REFERENCE TO RELATED APPLICATION

This application is based on and incorporates herein by reference Japanese Patent Application No. 2008-228005 filed on Sep. 5, 2008, and Japanese Patent Application No. 2009-021295 filed on Feb. 2, 2009.

BACKGROUND OF THE INVENTION

1. Field of the Invention

The present invention relates to an electromagnetic relay which opens and closes an electric circuit.

2. Description of Related Art

According to a conventional electromagnetic relay described in Japanese Unexamined Patent Application Publication No. 2006-351240, a fixed contact is positioned and held at a predetermined position by a fixed contact holding member, and a movable member, on which a moving contact is attached, is driven by electromagnetic force of a magnet coil, so that the moving contact is engaged with and disengaged from the fixed contact. Accordingly, the conventional relay opens and closes an electric circuit. Furthermore, a magnet is disposed near the moving contact and the fixed contact, and the conventional relay breaks arc, which is generated when the moving contact is disengaged from the fixed contact, as a result of extension of the arc by applying Lorentz force thereto. In addition, by extending a portion of the fixed contact holding member near the fixed contact and a portion of the movable member near the moving contact in a direction away from the magnet, the arc is not directed toward a side of the fixed contact holding member and the movable member.

However, the arc sometimes cannot be extended sufficiently, and thereby the arc cannot be reliably broken simply by disposing the magnet near the moving contact and the fixed contact as in the conventional electromagnetic relay. In an electromagnetic relay for high voltage (for example, a relay used for a hybrid electric vehicle with voltage of 400V), in particular, it is difficult to break the arc reliably because arc length becomes long.

SUMMARY OF THE INVENTION

The present invention addresses the above disadvantages. Thus, it is an objective of the present invention to reliably break arc.

To achieve the objective of the present invention, there is provided an electromagnetic relay including a fixed contact, a fixed contact holding member, a magnet coil, a movable member, a moving contact, and a magnet. The fixed contact is attached on one end side portion of the fixed contact holding member so as to be positioned and held at a predetermined position. The magnet coil is configured to generate electromagnetic force when energized. The movable member is driven by the electromagnetic force of the magnet coil. The moving contact is attached on one end side portion of the movable member so as to be engaged with or disengaged from the fixed contact as a result of whether the movable member is driven or not. The magnet is disposed on a lateral side of the fixed contact and the moving contact so as to apply Lorentz force to arc which is generated between the fixed contact and the moving contact. A contact alignment direction is a direction of a line passing through a center of the fixed contact and a center of the moving contact. A magnet arrangement direction is a direction of a line which is perpendicular to the contact alignment direction and which passes through the magnet. A Lorentz force application direction is a direction of the Lorentz force applied to the arc in a region in which the fixed contact and the moving contact are opposed to each other. An end face of the fixed contact holding member at the one end side portion thereof is opposed to the magnet. At least the one end side portion of the fixed contact holding member extends in a direction away from the magnet along the magnet arrangement direction. An end face of the movable member at the one end side portion thereof is opposed to the magnet. At least the one end side portion of the movable member extends in a direction away from the magnet along the magnet arrangement direction. The Lorentz force application direction is perpendicular to the contact alignment direction and the magnet arrangement direction. An end portion of the magnet on a side of the Lorentz force application direction extends further in the Lorentz force application direction than a side surface of the fixed contact holding member at the one end side portion thereof on a side of the Lorentz force application direction and a side surface of the movable member at the one end side portion thereof on a side of the Lorentz force application direction.

To achieve the objective of the present invention, there is also provided an electromagnetic relay including a cylindrical case, a plate-like base, a magnet coil, a movable member, a moving, contact, a fixed contact, a fixed contact holding member, and a magnet. The case has a bottom portion. The base is disposed to close an opening of the case. The magnet coil is disposed in an internal space defined by the case and the base and configured to generate electromagnetic force when energized. The movable member is disposed in the internal space and driven by the electromagnetic force of the magnet coil. The moving contact is attached on one end side portion of the movable member. The fixed contact is disposed in the internal space and engaged with or disengaged from the moving contact as a result of whether the movable member is driven or not. The fixed contact holding member is fixed to the base with the fixed contact holding member passing through the base and has a load circuit terminal, which projects into an exterior space and is connected to an external harness. The fixed contact is attached on one end side portion of the fixed contact holding member in the internal space. The magnet is disposed on a lateral side of the fixed contact and the moving contact so as to apply Lorentz force to arc which is generated between the fixed contact and the moving contact. A Lorentz force application direction is a direction of the Lorentz force applied to the arc in a region in which the fixed contact and the moving contact are opposed to each other. The case includes a guide part on a region of the case with which the arc extended in the Lorentz force application direction collides. The guide part is formed to guide the arc after the collision so as to extend the arc in a different direction from the Lorentz force application direction. The case further includes a case partition wall between the guide part and the base. The fixed contact holding member has a guide part opposing portion opposed to the guide part. The guide part opposing portion is covered with the case partition wall.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
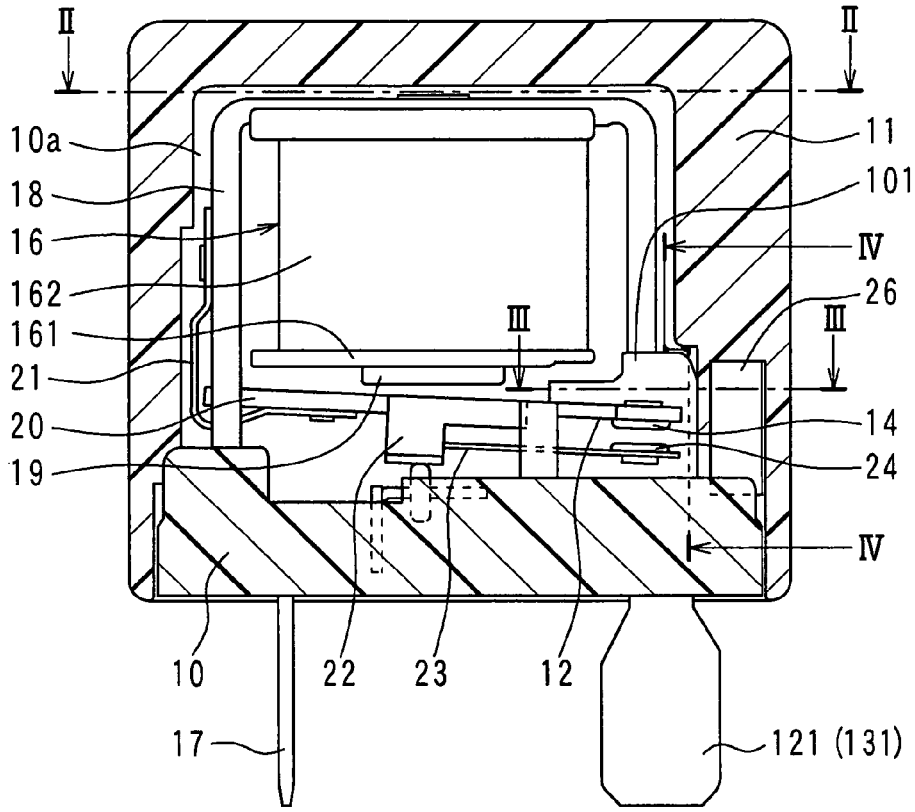
FIG. 1 is a sectional view illustrating an electromagnetic relay in accordance with a first embodiment of the invention.
Figure 2:
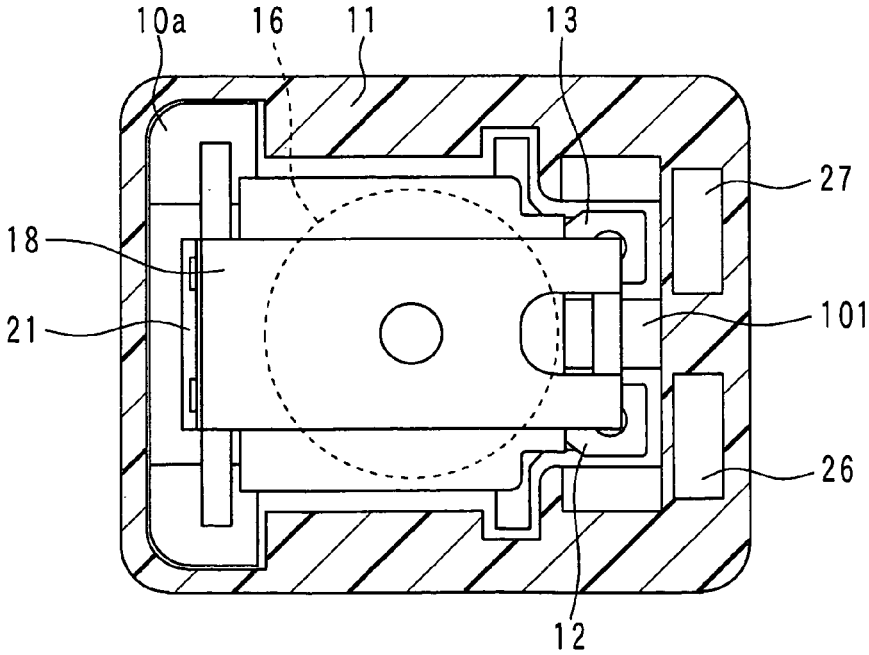
FIG. 2 is a cross-sectional view taken along a line II-II in FIG. 1.

A first embodiment of the invention is described below with reference to FIG. 1 to FIG. 4.

An electromagnetic relay of the first embodiment includes a plate-like base 10 made of resin and a rectangular parallelepiped case 11 made of resin and formed in a cylindrical shape having a bottom portion, with the case 11 fitted to the base 10. A space (hereinafter referred to as an internal space) 10*a* is defined inside the relay by the base 10 and the case 11.

Two fixed contact holding members 12, 13 made of conductive metal are fixed to the base 10. The two fixed contact holding members 12, 13 penetrate through the base 10, and their one end side is located in the internal space 10*a*, whereas the other end side is located in an exterior space.

Fixed contacts 14, 15 made of conductive metal are calked and fixed respectively on end portions of the two fixed contact holding members 12, 13 on the internal space 10*a* side. The two fixed contacts 14, 15 are positioned and held at predetermined positions by the two fixed contact holding members 12, 13.

Load circuit terminals 121, 131 connected to an external harness (not shown) are formed respectively on the exterior space sides of the two fixed contact holding members 12, 13. The load circuit terminal 121 of the first fixed contact holding member 12 is connected to a power source (not shown) via the external harness, and the load circuit terminal 131 of the second fixed contact holding member 13 is connected to an electric load (not shown) via the external harness.

Two coil terminals 17 (only one of them is shown) connected to a magnet coil 16, and a yoke 18 are fixed respectively to the base 10 by press fitting, for example.

The magnet coil 16 includes a bobbin 161 made of resin, and a coil wire 162 wound around the bobbin 161, and generates electromagnetic force upon energization thereof. A fixed core 19 made of a magnetic metallic material is disposed in a central hole of the bobbin 161.

The yoke 18 is made of a magnetic metallic material, and bent in a U-shaped manner. The yoke 18 constitutes a magnetic path of magnetic flux induced by the magnet coil 16. The magnet coil 16 is fixed to the yoke 18.

An armature 20 made of magnetic metal is disposed in a position opposed to the fixed core 19, and the armature 20 is attracted to the fixed core 19 side upon energization of the magnet coil 16. The armature 20 is connected to the yoke 18 via a connecting plate 21 made of metal and bent in a generally L-shape. The connecting plate 21 applies elastic force, which is in a direction in which the armature 20 disengages from the fixed core 19, to the armature 20 when the magnet coil 16 is not energized.

A U-shaped flat spring 23 made of conductive metal is connected to the armature 20 via a connecting member 22 made of resin. Moving contacts 24, 25 made of conductive metal are calked and fixed on both ends of the flat spring 23, and the first moving contact 24 is opposed to the first fixed contact 14, whereas the second moving contact 25 is opposed to the second fixed contact 15. The armature 20 and the flat spring 23 serve as a "movable member" of the invention.

A first permanent magnet 26 for applying Lorentz force to arc that is generated when the first moving contact 24 disengages from the first fixed contact 14 is disposed on a lateral side of the first fixed contact 14 and the first moving contact 24. A second permanent magnet 27 for applying Lorentz force to arc that is generated when the second moving contact 25 disengages from the second fixed contact 15 is disposed on a lateral side of the second fixed contact 15 and the second moving contact 25. These permanent magnets 26, 27, which are formed in a cylindrical shape, are inserted respectively in recesses formed on the side wall of the case 11.

A partition wall 101 projecting into the internal space 10*a* is formed on the base 10. With this partition wall 101, a space in which the first fixed contact 14 and the first moving contact 24 are disposed is divided off from a space in which the second fixed contact 15 and the second moving contact 25 are disposed.

A direction of a line passing through a center of the first fixed contact 14 and a center of the first moving contact 24 is referred to as a first contact alignment direction D1. A direction which is perpendicular to the first contact alignment direction D1 and which runs along a line passing through the first permanent magnet 26 is referred to as a first magnet arrangement direction E1. A direction of the Lorentz force applied to the arc in a region in which the first fixed contact 14 and the first moving contact 24 are opposed to each other is referred to as a first Lorentz force application direction F1.

An end face 122 of the first fixed contact holding member 12 located on the side on which the first fixed contact 14 is attached, is opposed to the first permanent magnet 26. A portion of the first fixed contact holding member 12 near the first fixed contact 14 extends in a direction away from the first permanent magnet 26 along the first magnet arrangement direction E1, and then the first fixed contact holding member 12 extends in a direction away from the second fixed contact holding member 13.

An end face 231 of the flat spring 23 on the side on which the first moving contact 24 is attached is opposed to the first permanent magnet 26, and a portion of the flat spring 23 near the first moving contact 24 extends in a direction away from the first permanent magnet 26 along the first magnet arrangement direction E1.

A direction of an electric current between the first fixed contact 14 and the first moving contact 24 and a direction of a magnetic flux in the region in which the first fixed contact 14 and the first moving contact 24 are opposed to each other are set, such that the first Lorentz force application direction F1 is perpendicular to the first contact alignment direction D1 and the first magnet arrangement direction E1 and runs in a direction away from the second fixed contact 15 and the second moving contact 25.

An end portion 261 of the first permanent magnet 26 on the first Lorentz force application direction F1 side extends further in the first Lorentz force application direction F1 than a side surface 123 of the first fixed contact holding member 12, on which the first fixed contact 14 is attached, on the first Lorentz force application direction F1 side and a side surface 232 of the flat spring 23, on which the first moving contact 24 is attached, on the first Lorentz force application direction F1 side.

An end portion 262 of the first permanent magnet 26 on the side opposite to the first Lorentz force application direction F1 extends further in a direction opposite to the first Lorentz force application direction F1 than an end portion 141 of the first fixed contact 14 on the side opposite to the first Lorentz force application direction F1 and an end portion 241 of the first moving contact 24 on the side opposite to the first Lorentz force application direction F1.

A recessed or grooved first guide part 111 is formed at a position of the inner wall part of the case 11 opposed to the first Lorentz force application direction F1 when viewed from the first fixed contact 14 and the first moving contact 24, in other words, at a portion of the inner wall part of the case 11 with which the arc extended in the first Lorentz force application direction F1 collides. The first guide part 111 extends in a direction parallel to the first contact alignment direction D1, and thereby guides the arc which has collided with the first guide part 111 in a direction generally parallel to the first contact alignment direction D1.

Next, a direction of a line passing through a center of the second fixed contact 15 and a center of the second moving contact 25 is referred to as a second contact alignment direction D2. A direction of a line which is perpendicular to the second contact alignment direction D2 and which passes through the second permanent magnet 27 is referred to as a second magnet arrangement direction E2. A direction of the Lorentz force applied to the arc in a region in which the second fixed contact 15 and the second moving contact 25 are opposed to each other is referred to as a second Lorentz force application direction F2.

An end face 132 of the second fixed contact holding member 13 located on the side on which the second fixed contact 15 is attached, is opposed to the second permanent magnet 27. A portion of the second fixed contact holding member 13 near the second fixed contact 15 extends in a direction away from the second permanent magnet 27 along the second magnet arrangement direction E2, and then the second fixed contact holding member 13 extends in a direction away from the first fixed contact holding member 12.

An end face 233 of the flat spring 23 on the side on which the second moving contact 25 is attached is opposed to the second permanent magnet 27, and a portion of the flat spring 23 near the second moving contact 25 extends in a direction away from the second permanent magnet 27 along the second magnet arrangement direction E2.

A direction of an electric current between the second fixed contact 15 and the second moving contact 25 and a direction of a magnetic flux in the region in which the second fixed contact 15 and the second moving contact 25 are opposed to each other are set, such that the second Lorentz force application direction F2 is perpendicular to the second contact alignment direction D2 and the second magnet arrangement direction E2 and runs in a direction away from the first fixed contact 14 and the first moving contact 24.

An end portion 271 of the second permanent magnet 27 on the second Lorentz force application direction F2 side extends further in the second Lorentz force application direction F2 than a side surface 133 of the second fixed contact holding member 13, on which the second fixed contact 15 is attached, on the second Lorentz force application direction F2 side and a side surface 234 of the flat spring 23, on which the second moving contact 25 is attached, on the second Lorentz force application direction F2 side.

An end portion 272 of the second permanent magnet 27 on the side opposite to the second Lorentz force application direction F2 extends further in a direction opposite to the second Lorentz force application direction F2 than an end portion 151 of the second fixed contact 15 on the side opposite to the second Lorentz force application direction F2 and an end portion 251 of the second moving contact 25 on the side opposite to the second Lorentz force application direction F2.

A recessed or grooved second guide part 112 is formed at a position of the inner wall part of the case 11 opposed to the second Lorentz force application direction F2 when viewed from the second fixed contact 15 and the second moving contact 25, in other words, at a portion of the inner wall part of the case 11 with which the arc extended in the second Lorentz force application direction F2 collides. The second guide part 112 extends in a direction parallel to the second contact alignment direction D2, and thereby guides the arc which has collided with the second guide part 112 in a direction generally parallel to the second contact alignment direction D2.

Workings of the electromagnetic relay according to the present embodiment are explained below. The armature 20 is attracted toward the fixed core 19 by the electromagnetic force upon energization of the magnet coil 16. Accordingly, the first moving contact 24 is brought into contact with the first fixed contact 14 and the second moving contact 25 is brought into contact with the second fixed contact 15, so that the two fixed contacts 14, 15 are contacted by the flat spring 23 so as to close the electric circuit. On the other hand, when the energization of the magnet coil 16 is stopped, the moving contacts 24, 25 are disengaged respectively from the fixed contacts 14, 15 by the elastic force of the connecting plate 21 so as to open the electric circuit.

The arc that is generated when the moving contacts 24, 25 disengage from the fixed contacts 14, 15 may be broken in the following manner.

Figure 3:
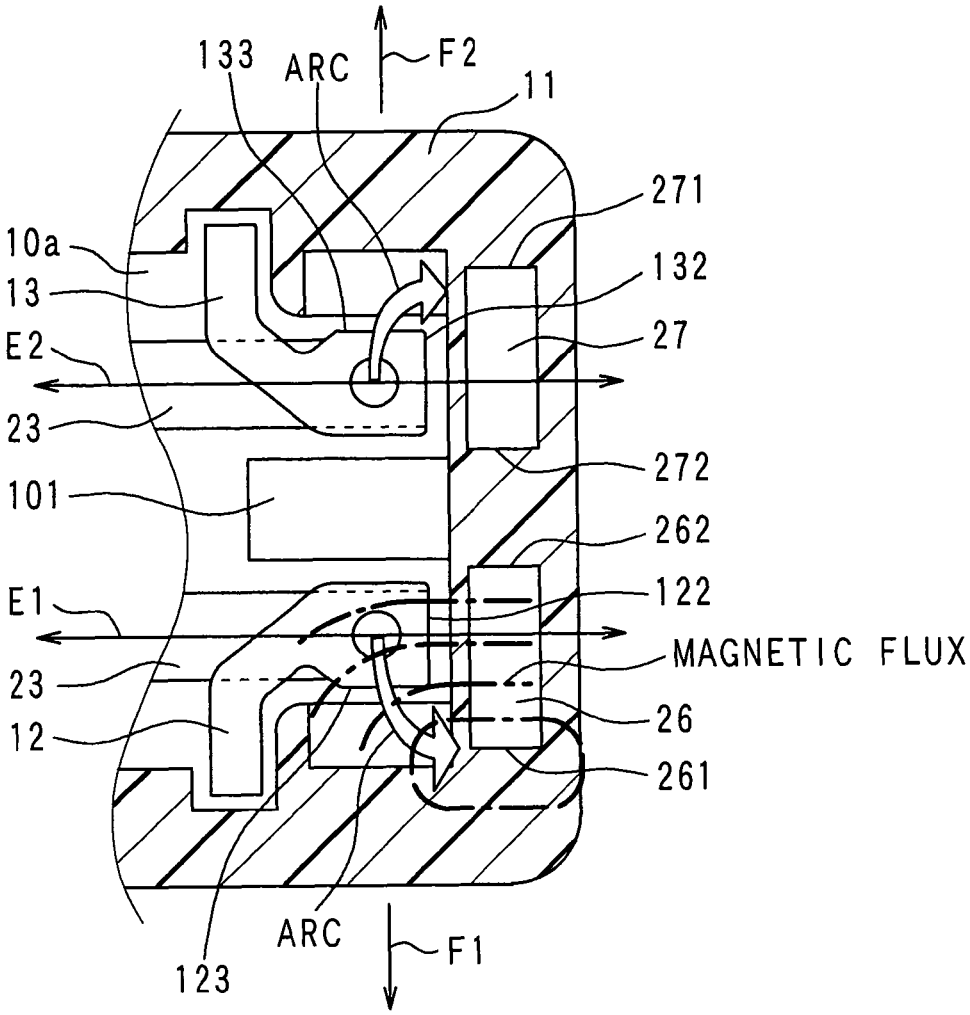
FIG. 3 is a cross-sectional view taken along a line III-III in FIG. 1.

The arc generated between the first fixed contact 14 and the first moving contact 24 is extended in the first Lorentz force application direction F1 by Lorentz force, as indicated by a white arrow in FIG. 3, and extended, being bent toward the end portion 261 of the first permanent magnet 26 on the first Lorentz force application direction F1 side. As a result, the arc is extended in a direction away from the first fixed contact holding member 12 and the flat spring 23.

The end portion 261 of the first permanent magnet 26 on the first Lorentz force application direction F1 side extends further in the first Lorentz force application direction F1 than the side surface 123 of the first fixed contact holding member 12 on the first Lorentz force application direction F1 side and the side surface 232 of the flat spring 23 on the first Lorentz force application direction F1 side. Therefore, the arc is extended longer than the conventional electromagnetic relay. Accordingly, when arc length is short as in an electromagnetic relay for low voltage, the arc is broken before the arc collides with the inner wall surface of the first guide part 111.

Figure 4:
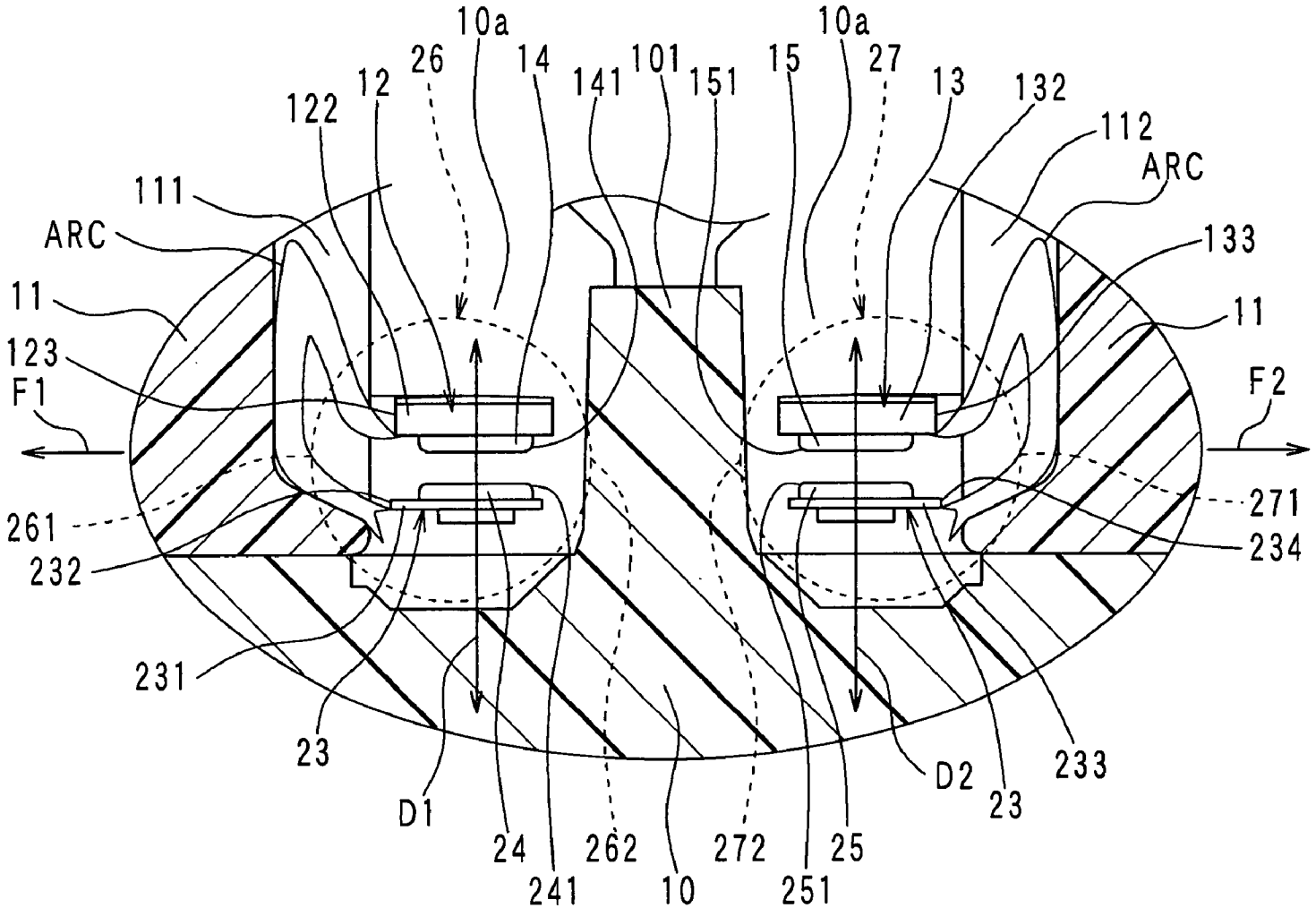
FIG. 4 is a sectional view taken along a line IV-IV in FIG. 1.
Figure 5:
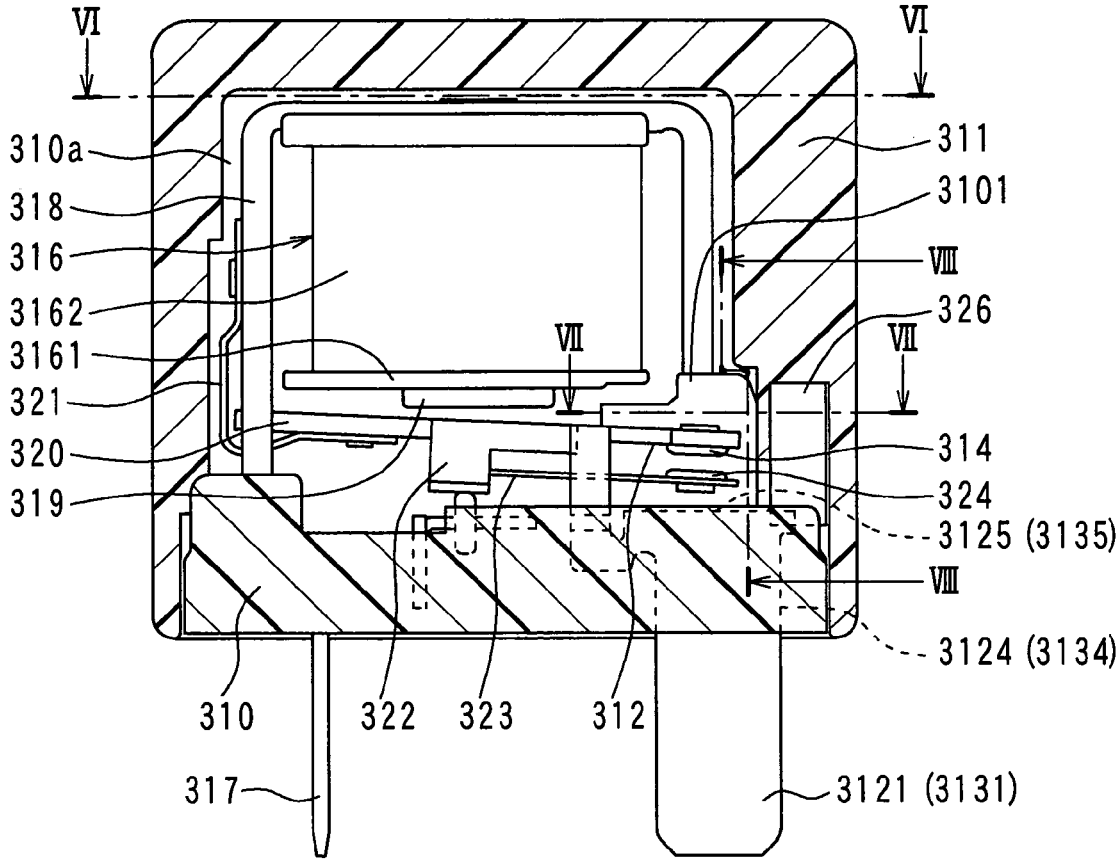
FIG. 5 is a sectional view illustrating an electromagnetic relay in accordance with a second embodiment of the invention.
Figure 6:
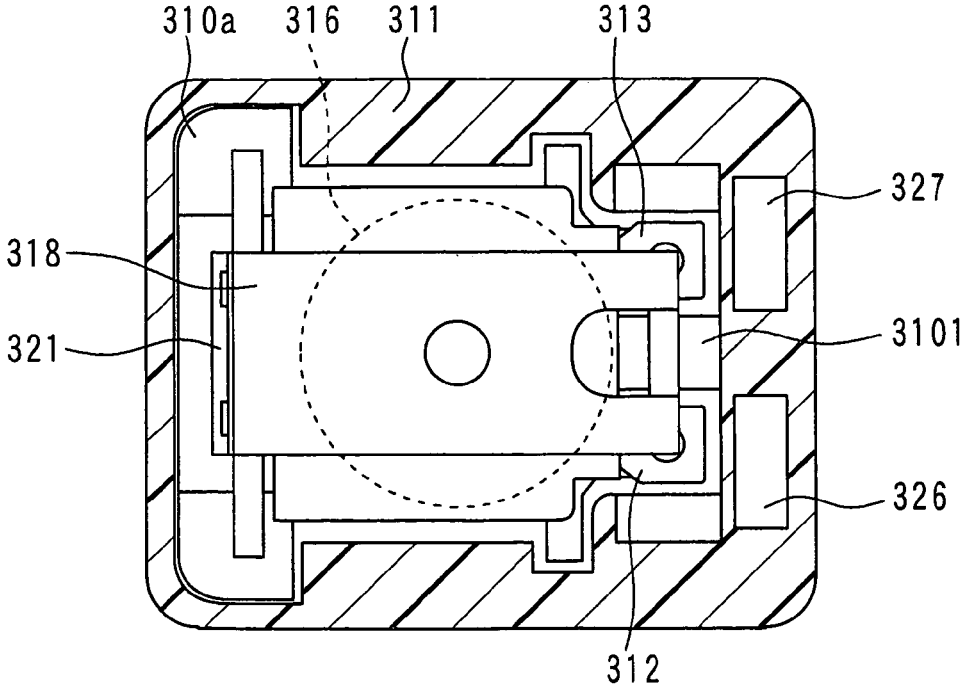
FIG. 6 is a cross-sectional view taken along a line VI-VI in FIG. 5.

When arc length is long as in an electromagnetic relay for high voltage, as shown in FIG. 4, the arc is guided by the first guide part 111 and extended in the direction generally parallel to the first contact alignment direction D1 after the arc collides with the inner wall surface of the first guide part 111. As a result, the arc is broken. In the above-described manner, because the arc extends along the first guide part 111, the arc is extended sufficiently even in a small space in the case 11, so that the arc is broken more reliably.

On the other hand, the arc generated between the second fixed contact 15 and the second moving contacts 25 is extended in the second Lorentz force application direction F2 by Lorentz force, as indicated by a white arrow in FIG. 3, and extended, being bent toward the end portion 271 of the second permanent magnet 27 on the second Lorentz force application direction F2 side. As a result, the arc is extended in a direction away from the second fixed contact holding member 13 and the flat spring 23.

The end portion 271 of the second permanent magnet 27 on the second Lorentz force application direction F2 side extends further in the second Lorentz force application direction F2 than the side surface 133 of the second fixed contact holding member 13 on the second Lorentz force application direction F2 side and the side surface 234 of the flat spring 23 on the second Lorentz force application direction F2 side. Therefore, the arc is extended longer than the conventional electromagnetic relay. Accordingly, when arc length is short as in an electromagnetic relay for low voltage, the arc is broken before the arc collides with the inner wall surface of the second guide part 112.

When arc length is long as in an electromagnetic relay for high voltage, as shown in FIG. 4, the arc is guided by the second guide part 112 and extended in the direction generally parallel to the second contact alignment direction D2 after the arc collides with the inner wall surface of the second guide part 112. As a result, the arc is broken. In the above-described manner, because the arc extends along the second guide part 112, the arc is extended sufficiently even in a small space in the case 11, so that the arc is broken more reliably.

Furthermore, in the first embodiment, voltage between the first fixed contact 14 and the first moving contact 24 and voltage between the second fixed contact 15 and the second moving contact 25 are reduced to half due to voltage dividing, so that the arc length becomes short. Therefore, the arc is broken more reliably.

In addition, the portion of the first fixed contact holding member 12 near the first fixed contact 14 extends in the direction away from the first permanent magnet 26 along the first magnet arrangement direction E1, and then the first fixed contact holding member 12 extends in the direction away from the second fixed contact holding member 13; and the portion of the second fixed contact holding member 13 near the second fixed contact 15 extends in the direction away from the second permanent magnet 27 along the second magnet arrangement direction E2, and then the second fixed contact holding member 13 extends in the direction away from the first fixed contact holding member 12. Therefore, insulation properties between the first fixed contact holding member 12 and the second fixed contact holding members 13 are improved.

(Modifications)

In the above-described embodiment, the guide parts 111, 112 are formed in order to break the arc reliably even when the arc length is long as in an electromagnetic relay for high voltage. However, the guide parts 111, 112 may be unnecessary when the arc length is short as in an electromagnetic relay for low voltage.

Also, in the above embodiment, two pairs of engaging and disengaging contacts are provided to reduce the voltage between contacts to half by voltage dividing. Alternatively, a pair of engaging and disengaging contacts may be provided if the voltage between contacts need not be reduced.

Second Embodiment

A second embodiment of the invention is described below with reference to FIG. 5 to FIG. 9C. An electromagnetic relay according to the second embodiment includes a plate-like base 310 made of resin and a rectangular parallelepiped case 311 made of resin and formed in a cylindrical shape having a bottom portion. The base 310 is fitted in the case 311 so as to close an opening of the case 311, and a space (hereinafter referred to as an internal space) 310*a* is defined inside the relay by the base 310 and the case 311.

Two fixed contact holding members 312, 313 made of conductive metal are fixed to the base 310. The two fixed contact holding members 312, 313 penetrate through the base 310, and their one end side is located in the internal space 310*a*, whereas the other end side is located in an exterior space. In addition, their intermediate portions are located in through holes of the base 310.

Fixed contacts 314, 315 made of conductive metal are calked and fixed respectively on end portions of the two fixed contact holding members 312, 313 on the internal space 310*a* side. The two fixed contacts 314, 315 are positioned and held at predetermined positions by the two fixed contact holding members 312, 313.

Load circuit terminals 3121, 3131 connected to an external harness (not shown) are formed respectively on the exterior space sides of the two fixed contact holding members 312, 313. The first load circuit terminal 3121 of the first fixed contact holding member 312 is connected to a power source (not shown) via the external harness, and the second load circuit terminal 3131 of the second fixed contact holding member 313 is connected to an electric load (not shown) via the external harness.

Figure 9B:
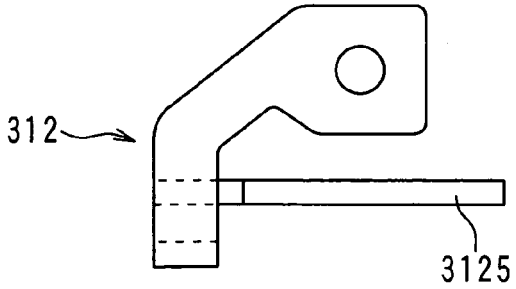
FIG. 9B is a plan view of FIG. 9A.
Figure 9A:
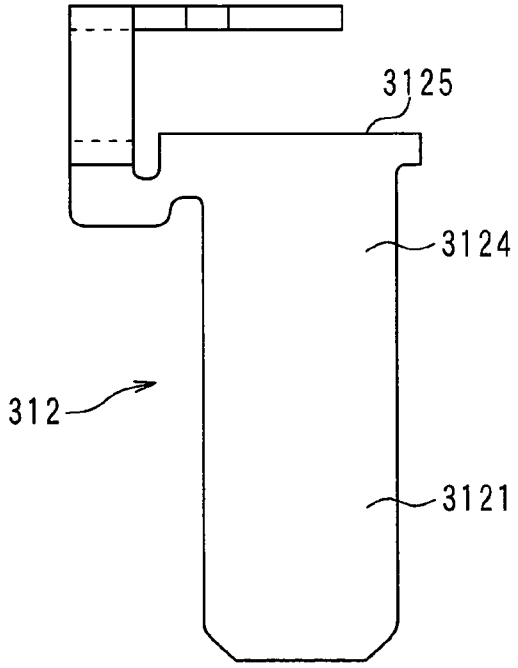
FIG. 9A is a front view illustrating a fixed contact holding member in FIG. 5.
Figure 9C:
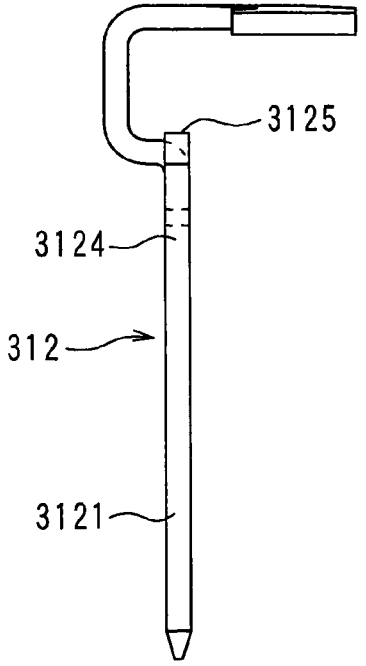
FIG. 9C is a right side view of FIG. 9A.

As shown in FIG. 9A to FIG. 9C, the two fixed contact holding members 312, 313 connect with the load circuit terminals 3121, 3131 respectively, and have insertion plate portions 3124, 3134 located in the through holes of the base 310, respectively. The two fixed contact holding members 312, 313 are assembled by being press-fitted into the through holes of the base 310 from the internal space 310*a* side. Insertion plate portion end faces 3125, 3135, which are end faces of the insertion plate portions 3124, 3134 on their opposite sides from the load circuit terminals 3121, 3131, are exposed through the base 310. In addition, the insertion plate portion end faces 3125, 3135 correspond to a "guide part opposing portion" of the invention.

Two coil terminals 317 (only one of them is shown) connected to a magnet coil 316, and a yoke 318 are fixed respectively to the base 310 by press fitting, for example.

The magnet coil 316 includes a bobbin 3161 made of resin, and a coil wire 3162 wound around the bobbin 3161, and generates electromagnetic force upon energization thereof. A fixed core 319 made of a magnetic metallic material is disposed in a central hole of the bobbin 3161.

The yoke 318 is made of a magnetic metallic material, and bent in a U-shaped manner. The yoke 318 constitutes a magnetic path of magnetic flux induced by the magnet coil 316. The magnet coil 316 is fixed to the yoke 318.

An armature 320 made of magnetic metal is disposed in a position opposed to the fixed core 319, and the armature 320 is attracted to the fixed core 319 side upon energization of the magnet coil 316. The armature 320 is connected to the yoke 318 via a connecting plate 321 made of metal and bent in a generally L-shape. The connecting plate 321 applies elastic force, which is in a direction in which the armature 320 disengages from the fixed core 319, to the armature 320 when the magnet coil 316 is not energized.

A U-shaped flat spring 323 made of conductive metal is connected to the armature 320 via a connecting member 322 made of resin. Moving contacts 324, 325 made of conductive metal are calked and fixed on both ends of the flat spring 323, and the first moving contact 324 is opposed to the first fixed contact 314, whereas the second moving contact 325 is opposed to the second fixed contact 315. The armature 320 and the flat spring 323 serve as a "movable member" of the invention.

A first permanent magnet 326 for applying Lorentz force to arc that is generated when the first moving contact 324 disengages from the first fixed contact 314 is disposed on a lateral side of the first fixed contact 314 and the first moving contact 324. A second permanent magnet 327 for applying Lorentz force to arc that is generated when the second moving contact 325 disengages from the second fixed contact 315 is disposed on a lateral side of the second fixed contact 315 and the second moving contact 325. These permanent magnets 326, 327, which are formed in a cylindrical shape, are inserted respectively in recesses formed on the side wall of the case 311.

A base partition wall 3101 projecting into the internal space 310*a* is formed on the base 310. With this base partition wall 3101, a space in which the first fixed contact 314 and the first moving contact 324 are disposed is divided off from a space in which the second fixed contact 315 and the second moving contact 325 are disposed.

A direction of a line passing through a center of the first fixed contact 314 and a center of the first moving contact 324 is referred to as a first contact alignment direction d1. A direction which is perpendicular to the first contact alignment direction d1 and which runs along a line passing through the first permanent magnet 326 is referred to as a first magnet arrangement direction e1. A direction of the Lorentz force applied to the arc in a region in which the first fixed contact 314 and the first moving contact 324 are opposed to each other is referred to as a first Lorentz force application direction f1.

An end face 3122 of the first fixed contact holding member 312 located on the side on which the first fixed contact 314 is attached, is opposed to the first permanent magnet 326. A portion of the first fixed contact holding member 312 near the first fixed contact 314 extends in a direction away from the first permanent magnet 326 along the first magnet arrangement direction e1, and then the first fixed contact holding member 312 extends in a direction away from the second fixed contact holding member 313.

An end face 3231 of the flat spring 323 on the side on which the first moving contact 324 is attached is opposed to the first permanent magnet 326, and a portion of the flat spring 323 near the first moving contact 324 extends in a direction away from the first permanent magnet 326 along the first magnet arrangement direction e1.

A direction of electric current between the first fixed contact 314 and the first moving contact 324 and a direction of a magnetic flux in the region in which the first fixed contact 314 and the first moving contact 324 are opposed to each other are set, such that the first Lorentz force application direction f1 is perpendicular to the first contact alignment direction d1 and the first magnet arrangement direction e1 and runs in a direction away from the second fixed contact 315 and the second moving contact 325.

An end portion 3261 of the first permanent magnet 326 on the first Lorentz force application direction f1 side extends further in the first Lorentz force application direction f1 than a side surface 3123 of the first fixed contact holding member 312, on which the first fixed contact 314 is attached, on the first Lorentz force application direction f1 side and a side surface 3232 of the flat spring 323, on which the first moving contact 324 is attached, on the first Lorentz force application direction f1 side.

An end portion 3262 of the first permanent magnet 326 on the side opposite to the first Lorentz force application direction f1 extends further in a direction opposite to the first Lorentz force application direction f1 than an end portion 3141 of the first fixed contact 314 on the side opposite to the first Lorentz force application direction f1 and an end portion 3241 of the first moving contact 324 on the side opposite to the first Lorentz force application direction f1.

A recessed or grooved first guide part 3111 is formed at a position of the inner wall part of the case 311 opposed to the first Lorentz force application direction f1 when viewed from the first fixed contact 314 and the first moving contact 324, in other words, at a portion of the inner wall part of the case 311 with which the arc extended in the first Lorentz force application direction f1 collides. The first guide part 3111 extends in a direction parallel to the first contact alignment direction d1, and thereby guides the arc which has collided with the first guide part 3111 in a direction generally parallel to the first contact alignment direction d1 (i.e., in a direction that is different from the Lorentz force application direction f1).

In other words, the first guide part 3111 extends from a portion of the inner wall part of the case 311 with which the arc first collides, toward the bottom of the case 311, so as to guide the arc which has collided with the first guide part 3111 from the opening side toward the bottom of the case 311.

A first case partition wall 3113 is formed on the case 311 between the first guide part 3111 and the base 310. The first insertion plate portion end face 3125 of the first fixed contact holding member 312 is covered with the first case partition wall 3113.

A direction of a line passing through a center of the second fixed contact 315 and a center of the second moving contact 325 is referred to as a second contact alignment direction d2. A direction which is perpendicular to the second contact alignment direction d2 and which runs along a line passing through the second permanent magnet 327 is referred to as a second magnet arrangement direction e2. A direction of the Lorentz force applied to the arc in a region in which the second fixed contact 315 and the second moving contact 325 are opposed to each other is referred to as a second Lorentz force application direction f2.

An end face 3132 of the second fixed contact holding member 313 located on the side on which the second fixed contact 315 is attached, is opposed to the second permanent magnet 327. A portion of the second fixed contact holding member 313 near the second fixed contact 315 extends in a direction away from the second permanent magnet 327 along the second magnet arrangement direction e2, and then the second fixed contact holding member 313 extends in a direction away from the first fixed contact holding member 312.

An end face 3233 of the flat spring 323 on the side on which the second moving contact 325 is attached is opposed to the second permanent magnet 327, and a portion of the flat spring 323 near the second moving contact 325 extends in a direction away from the second permanent magnet 327 along the second magnet arrangement direction e2.

A direction of electric current between the second fixed contact 315 and the second moving contact 325 and a direction of a magnetic flux in the region in which the second fixed contact 315 and the second moving contact 325 are opposed to each other are set, such that the second Lorentz force application direction f2 is perpendicular to the second contact alignment direction d2 and the second magnet arrangement direction e2 and runs in a direction away from the first fixed contact 314 and the first moving contact 324.

An end portion 3271 of the second permanent magnet 327 on the second Lorentz force application direction f2 side extends further in the second Lorentz force application direction f2 than a side surface 3133 of the second fixed contact holding member 313, on which the second fixed contact 315 is attached, on the second Lorentz force application direction f2 side and a side surface 3234 of the flat spring 323, on which the second moving contact 325 is attached, on the second Lorentz force application direction f2 side.

An end portion 3272 of the second permanent magnet 327 on the side opposite to the second Lorentz force application direction f2 extends further in a direction opposite to the second Lorentz force application direction f2 than an end portion 3151 of the second fixed contact 315 on the side opposite to the second Lorentz force application direction f2 and an end portion 3251 of the second moving contact 325 on the side opposite to the second Lorentz force application direction f2.

A recessed or grooved second guide part 3112 is formed at a position of the inner wall part of the case 311 opposed to the second Lorentz force application direction f2 when viewed from the second fixed contact 315 and the second moving contact 325, in other words, at a portion of the inner wall part of the case 311 with which the arc extended in the second Lorentz force application direction f2 collides. The second guide part 3112 extends in a direction parallel to the second contact alignment direction d2, and thereby guides the arc which has collided with the second guide part 3112 in a direction generally parallel to the second contact alignment direction d2 (i.e., in a direction that is different from the Lorentz force application direction f2).

In other words, the second guide part 3112 extends from a portion of the inner wall part of the case 311 with which the arc first collides, toward the bottom of the case 311, so as to guide the arc which has collided with the second guide part 3112 from the opening side toward the bottom of the case 311.

A second case partition wall 3114 is formed on the case 311 between the second guide part 3112 and the base 310. The second insertion plate portion end face 3135 of the second fixed contact holding member 313 is covered with the second case partition wall 3114.

Next, workings of the electromagnetic relay according to the second embodiment are described below. The armature 320 is attracted toward the fixed core 319 by the electromagnetic force upon energization of the magnet coil 316. Accordingly, the first moving contact 324 is brought into contact with the first fixed contact 314 and the second moving contact 325 is brought into contact with the second fixed contact 315, so that the two fixed contacts 314, 315 are contacted by the flat spring 323 so as to close the electric circuit. On the other hand, when the energization of the magnet coil 316 is stopped, the moving contacts 324, 325 are disengaged respectively from the fixed contacts 314, 315 by the elastic force of the connecting plate 321 so as to open the electric circuit.

The arc that is generated when the moving contacts 324, 325 disengage from the fixed contacts 314, 315 may be broken in the following manner.

Figure 7:
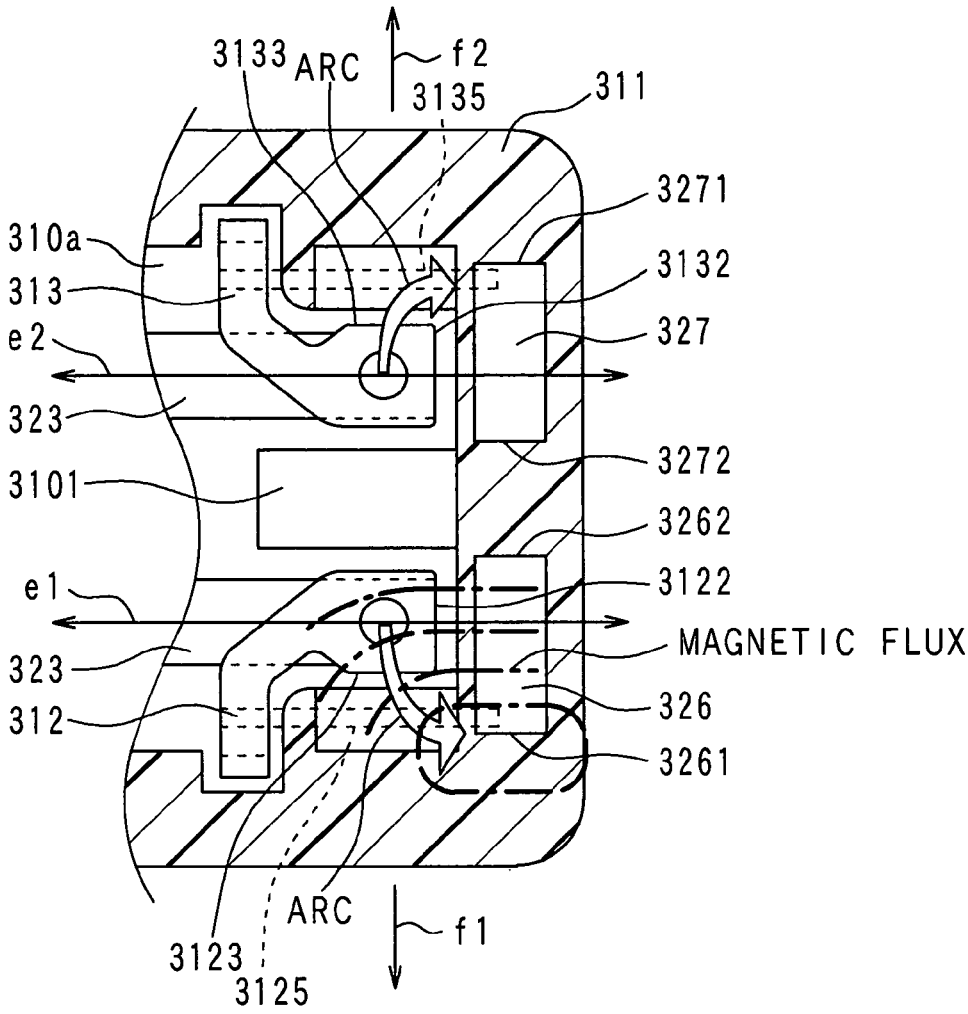
FIG. 7 is a cross-sectional view taken along a line VII-VII in FIG. 5.

The arc generated between the first fixed contact 314 and the first moving contact 324 is extended in the first Lorentz force application direction f1 by Lorentz force, as indicated by a white arrow in FIG. 7, and is extended, being bent toward the end portion 3261 of the first permanent magnet 326 on the first Lorentz force application direction f1 side. As a result, the arc is extended in a direction away from the first fixed contact holding member 312 and the flat spring 323.

The end portion 3261 of the first permanent magnet 326 on the first Lorentz force application direction f1 side extends further in the first Lorentz force application direction f1 than the side surface 3123 of the first fixed contact holding member 312 on the first Lorentz force application direction f1 side and the side surface 3232 of the flat spring 323 on the first Lorentz force application direction f1 side. Therefore, the arc is extended longer than the conventional electromagnetic relay. Accordingly, when arc length is short as in an electromagnetic relay for low voltage, the arc is broken before the arc collides with the inner wall surface of the first guide part 3111.

Figure 8:
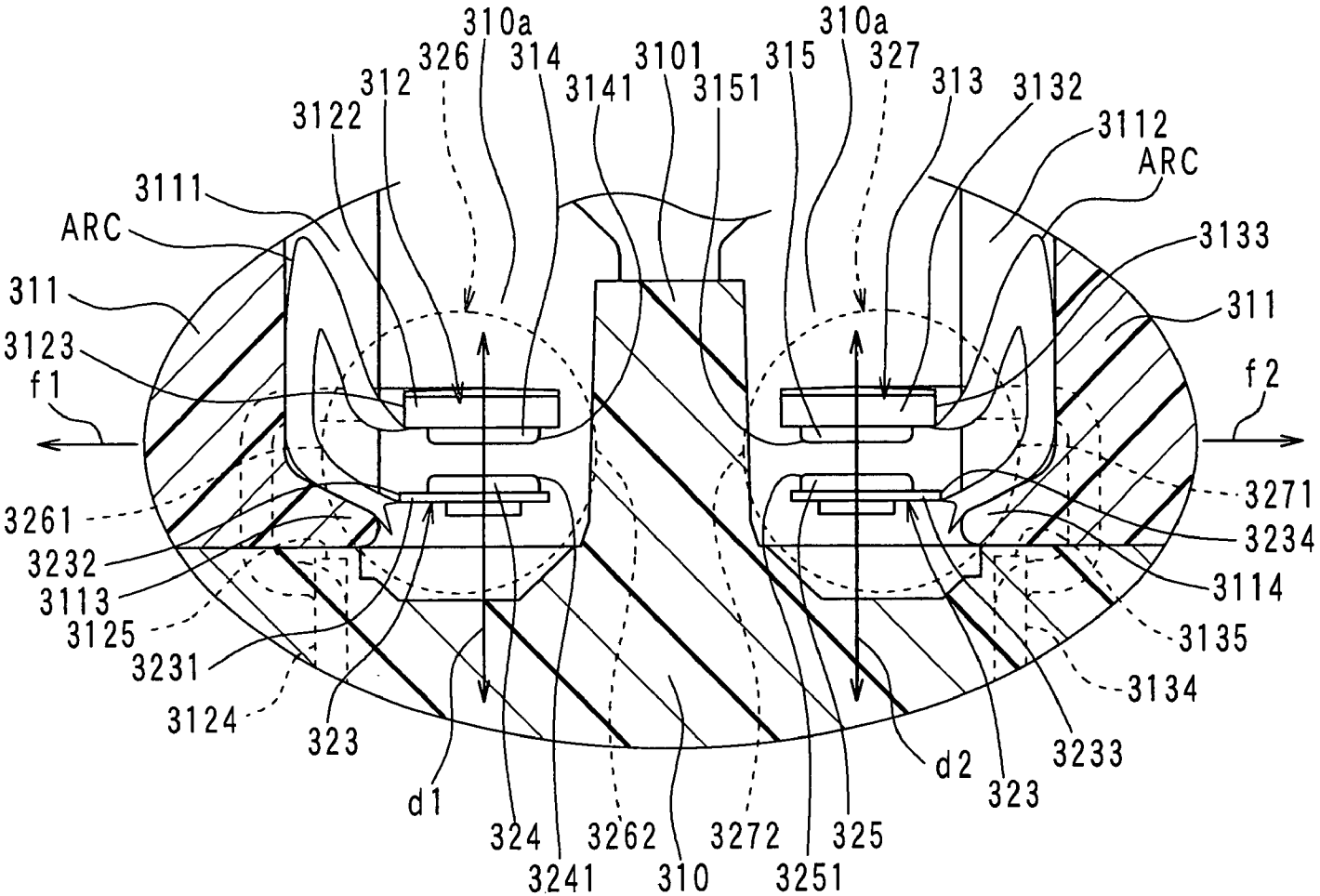
FIG. 8 is a sectional view taken along a line VIII-VIII in FIG. 5.

When arc length is long as in an electromagnetic relay for high voltage, as shown in FIG. 8, the arc is guided by the first guide part 3111 and extended toward the bottom of the case 311 after the arc collides with the inner wall surface of the first guide part 3111. As a result, the arc is broken. In the above-described manner, because the arc extends along the first guide part 3111, the arc is extended sufficiently even in a small space in the case 311, so that the arc is broken more reliably.

Since the first insertion plate portion end face 3125 of the first fixed contact holding member 312 is covered by the first case partition wall 3113, a short circuit between the first insertion plate portion end face 3125 and the arc in the first guide part 3111 is prevented.

On the other hand, the arc generated between the second fixed contact 315 and the second moving contact 325 is extended in the second Lorentz force application direction f2 by Lorentz force, as indicated by a white arrow in FIG. 7, and is extended, being bent toward the end portion 3271 of the second permanent magnet 327 on the second Lorentz force application direction f2 side. As a result, the arc is extended in a direction away from the second fixed contact holding member 313 and the flat spring 323.

The end portion 3271 of the second permanent magnet 327 on the second Lorentz force application direction f2 side extends further in the second Lorentz force application direction f2 than the side surface 3133 of the second fixed contact holding member 313 on the second Lorentz force application direction f2 side and the side surface 3234 of the flat spring 323 on the second Lorentz force application direction f2 side. Therefore, the arc is extended longer than the conventional electromagnetic relay. Accordingly, when arc length is short as in an electromagnetic relay for low voltage, the arc is broken before the arc collides with the inner wall surface of the second guide part 3112.

When arc length is long as in an electromagnetic relay for high voltage, as shown in FIG. 8, the arc is guided by the second guide part 3112 and extended toward the bottom of the case 311 after the arc collides with the inner wall surface of the second guide part 3112. As a result, the arc is broken. In the above-described manner, because the arc extends along the second guide part 3112, the arc is extended sufficiently even in a small space in the case 311, so that the arc is broken more reliably.

Since the insertion plate portion end face 3135 of the second fixed contact holding member 313 is covered by the second case partition wall 3114, a short circuit between the second insertion plate portion end face 3135 and the arc in the second guide part 3112 is prevented.

Furthermore, in the second embodiment, voltage between the first fixed contact 314 and the first moving contacts 324 and voltage between the second fixed contact 315 and the second moving contacts 325 are reduced to half due to voltage dividing, so that the arc length becomes short. Therefore, the arc is broken more reliably.

In addition, the portion of the first fixed contact holding member 312 near the first fixed contact 314 extends in the direction away from the first permanent magnet 326 along the first magnet arrangement direction e1, and then the first fixed contact holding member 312 extends in the direction away from the second fixed contact holding member 313; and the portion of the second fixed contact holding member 313 near the second fixed contact 315 extends in the direction away from the second permanent magnet 327 along the second magnet arrangement direction e2, and then the second fixed contact holding member 313 extends in the direction away from the first fixed contact holding member 312. Therefore, insulation properties between the first fixed contact holding member 312 and the second fixed contact holding member 313 are improved.

(Modifications)

In the above embodiment, two pairs of engaging and disengaging contacts are provided to reduce the voltage between contacts to half by voltage dividing. Alternatively, a pair of engaging and disengaging contacts may be provided if the voltage between contacts need not be reduced.

Additional advantages and modifications will readily occur to those skilled in the art. The invention in its broader terms is therefore not limited to the specific details, representative apparatus, and illustrative examples shown and described.

What is claimed is:

1. An electromagnetic relay comprising:

a fixed contact;

a fixed contact holding member, wherein the fixed contact is attached on one end side portion of the fixed contact holding member so as to be positioned and held at a predetermined position;

a magnet coil configured to generate electromagnetic force when energized;

a movable member driven by the electromagnetic force of the magnet coil;

a moving contact attached on one end side portion of the movable member so as to be engaged with or disengaged from the fixed contact as a result of whether the movable member is driven or not; and a magnet disposed on a lateral side of the fixed contact and the moving contact so as to apply Lorentz force to an arc which is generated between the fixed contact and the moving contact, wherein:

given that:

a contact alignment direction is a direction of a line passing through a center of the fixed contact and a center of the moving contact;

a magnet arrangement direction is a direction of a line which is perpendicular to the contact alignment direction and which passes through the magnet; and a Lorentz force application direction is a direction of the Lorentz force applied to the arc in a region in which the fixed contact and the moving contact are opposed to each other, an end face of the fixed contact holding member at the one end side portion thereof is opposed to the magnet;

at least the one end side portion of the fixed contact holding member extends in a direction away from the magnet along the magnet arrangement direction;

an end face of the movable member at the one end side portion thereof is opposed to the magnet;

at least the one end side portion of the movable member extends in a direction away from the magnet along the magnet arrangement direction;

the Lorentz force application direction is perpendicular to the contact alignment direction and the magnet arrangement direction; and an end portion of the magnet on a side of the Lorentz force application direction extends further in the Lorentz force application direction than a side surface of the fixed contact holding member at the one end side portion thereof on a side of the Lorentz force application direction and a side surface of the movable member at the one end side portion thereof on a side of the Lorentz force application direction;

the fixed contact includes a first fixed contact and a second fixed contact;

the fixed contact holding member includes a first fixed contact holding member on which the first fixed contact is attached and a second fixed contact holding member on which the second fixed contact is attached;

the moving contact includes a first moving contact and a second moving contact which are attached on the movable member, the first moving contact being engaged with or disengaged from the first fixed contact and the second moving contact being engaged with or disengaged from the second fixed contact;

when the first moving contact is brought into contact with the first fixed contact and the second moving contact is brought into contact with the second fixed contact, the first fixed contact and the second fixed contact become conductive therebetween via the movable member;

the first fixed contact holding member extends from one end side portion thereof in a direction away from the magnet along the magnet arrangement direction, and then extends in a direction away from the second fixed contact holding member; and the second fixed contact holding member extends from one end side portion thereof in a direction away from the magnet along the magnet arrangement direction, and then extends in a direction away from the first fixed contact holding member.

2. The electromagnetic relay according to claim 1, further comprising a case which accommodates the fixed contact, the fixed contact holding member, the magnet coil, the movable member, the moving contact, and the magnet, wherein:

the case includes a guide part formed on a region of an inner wall part of the case with which the arc extended in the Lorentz force application direction collides; and the guide part guides the arc in a direction generally parallel to the contact alignment direction.

3. An electromagnetic relay comprising:

a fixed contact holding member;

a fixed contact attached to a bottom side of a first end portion of the fixed contact holding member so as to be positioned and held at a predetermined position;

a magnet coil configured to generate electromagnetic force when energized;

a movable member driven by the electromagnetic force of the magnet coil;

a moving contact attached to a top side of a first end portion of the movable member so as to be engaged with or disengaged from the fixed contact as a result of whether the movable member is driven or not; and a magnet disposed adjacent to the fixed contact and the moving contact so as to apply Lorentz force to an arc generated between the fixed contact and the moving contact, a contact alignment direction is a direction of a line that passes through a center of the fixed contact and a center of the moving contact;

a magnet arrangement direction is a direction of a line that is perpendicular to the contact alignment direction and that passes through the magnet; and a Lorentz force application direction is a direction of the Lorentz force applied to the arc in a region in which the fixed contact and the moving contact are opposed to each other, wherein a first side surface of the fixed contact holding member at the first end portion thereof is opposed to the magnet, a portion of the fixed contact holding member extends away from the fixed contact in a direction away from the magnet along the magnet arrangement direction;

a first side surface of the movable member at the first end portion thereof is opposed to the magnet, a portion of the movable member extends away from the moving contact in a direction away from the magnet along the magnet arrangement direction, the Lorentz force application direction is perpendicular to both the contact alignment direction and the magnet arrangement direction, a side portion of the magnet extending in the Lorentz force application direction extends further in the Lorentz force application direction than a second side surface of the fixed contact holding member at the first end portion thereof, a side portion of the magnet extending in the Lorentz force application direction extends further in the Lorentz force application direction than a second side surface of the movable member at the first end portion thereof, the second side surface of the fixed contact holding member is perpendicular to the first side surface of the fixed contact holding member, and the second side surface of the movable member is perpendicular to the first side surface of the movable member, the fixed contact includes a first fixed contact and a second fixed contact, the fixed contact holding member includes a first fixed contact holding member on which the first fixed contact is attached and a second fixed contact holding member on which the second fixed contact is attached, the moving contact includes a first moving contact and a second moving contact which are attached on the movable member, the first moving contact being engaged with or disengaged from the first fixed contact and the second moving contact being engaged with or disengaged from the second fixed contact, when the first moving contact is brought into contact with the first fixed contact and the second moving contact is brought into contact with the second fixed contact, the first fixed contact and the second fixed contact become conductive therebetween via the movable member, a first portion of the first fixed contact holding member extends away from the first fixed contact in a first direction away from the magnet along the magnet arrangement direction, a second portion of the first fixed contact holding member extends in a second direction away from the second fixed contact holding member, the second direction being different than the first direction, a first portion of the second fixed contact holding member extends away from the second fixed contact in the first direction away from the magnet along the magnet arrangement direction, and a second portion of the second fixed contact holding member extends laterally in a third direction away from the first fixed contact holding member, the third direction being different than the first and second directions.

4. The electromagnetic relay according to claim 3, further comprising:

a case which accommodates the fixed contact, the fixed contact holding member, the magnet coil, the movable member, the moving contact, and the magnet, wherein the case includes a guide part formed on a region of an inner wall part of the case with which the arc extended in the Lorentz force application direction collides, and wherein the guide part guides the arc in a direction generally parallel to the contact alignment direction.

* * * * *